US006634059B2

(12) United States Patent
Seiferd

(10) Patent No.: US 6,634,059 B2
(45) Date of Patent: Oct. 21, 2003

(54) REINFORCEMENT HARDWARE FOR A DOORJAMB BRACKET

(75) Inventor: Scott D. Seiferd, St. Charles, MO (US)

(73) Assignee: Innovative Product Solutions, Inc., St. Louis, MO (US)

( * ) Notice: Subject to any disclaimer, the term of this patent is extended or adjusted under 35 U.S.C. 154(b) by 0 days.

(21) Appl. No.: 09/930,524

(22) Filed: Aug. 15, 2001

(65) Prior Publication Data

US 2002/0026684 A1 Mar. 7, 2002

Related U.S. Application Data

(60) Provisional application No. 60/226,070, filed on Aug. 17, 2000.

(51) Int. Cl.[7] ..... E05F 1/00

(52) U.S. Cl. ..... 16/71; 16/72; 16/66; 16/DIG. 40

(58) Field of Search ..... 16/71, 72, 66, 16/78, 79, 80, 82–85, 49, 51, 52, 57, 58, DIG. 40

(56) References Cited

U.S. PATENT DOCUMENTS

| | | | | |
|---|---|---|---|---|
| 1,346,029 A | * | 7/1920 | Hubbard | 16/271 |
| 1,469,525 A | * | 10/1923 | Nadolney | 16/271 |
| 1,481,142 A | * | 1/1924 | Minton et al. | 16/271 |
| 3,888,445 A | | 6/1975 | Pence | |
| 4,648,151 A | | 3/1987 | Whaley | |
| 4,825,509 A | | 5/1989 | Mitchell et al. | |
| 5,152,487 A | * | 10/1992 | Defatte et al. | 16/66 |
| 5,829,098 A | | 11/1998 | Alonso | |
| 6,397,431 B1 | * | 6/2002 | Alonso | 16/66 |

OTHER PUBLICATIONS

Patent Application Publication, US 2001/0007163 A1, (Alonso).*

* cited by examiner

*Primary Examiner*—Chuck Y. Mah
(74) *Attorney, Agent, or Firm*—Grace J. Fishel

(57) ABSTRACT

A reinforcement plate for use in attaching a doorjamb bracket to a doorjamb, the plate member having an aperture through which the arm of a conventional doorjamb bracket may be inserted. A plurality of holes in the plate member are available for receiving fasteners to secure the reinforcement plate to the doorjamb. The base of the conventional doorjamb bracket is received within an chambered area in the plate member so that the reinforcement plate lies substantially flush with the surface of the doorjamb. At least one opening in the reinforcement plate is positioned and shaped to allow a fastener to extend simultaneously through both the reinforcement plate and a hole associated with the doorjamb bracket so as to simultaneously attach both the reinforcement plate and the doorjamb bracket to the doorjamb.

22 Claims, 4 Drawing Sheets

REINFORCEMENT HARDWARE FOR A DOORJAMB BRACKET

CROSS REFERENCE TO RELATED APPLICATION

This application is based on and claims priority of Provisional Patent Application Ser. No. 60/226,070 for REINFORCEMENT HARDWARE FOR A DOORJAMB BRACKET filed Aug. 17, 2000.

BACKGROUND OF INVENTION

The present invention relates to reinforcement hardware for attaching a doorjamb bracket associated with a conventional door closure system to a doorjamb and, more particularly, to several embodiments of an assembly which either overlays or mates with the doorjamb bracket so as to reinforce and improve the attachment thereof to a doorjamb, the doorjamb bracket being securely held between the present assembly and the doorjamb.

A common door closure system for use in conjunction with a wide variety of different doors including screen and storm doors typically includes a piston assembly of some type having a piston, a piston rod, and a cylindrical piston tube associated therewith as well as a hold-open bracket, a doorjamb bracket for attachment to a doorjamb, and an adjustable door bracket for attachment to the door. The doorjamb bracket is generally manufactured from a single piece of metal or other suitable material which is stamped into a distinct and functional configuration. The doorjamb bracket attaches to the doorjamb and provides surface clearance for the door closure system away from the surface of the door and the doorjamb. The doorjamb bracket includes a base having a plurality of fastener screw holes associated therewith for attaching the bracket to the doorjamb and an arm structure adapted for receiving and holding one end of the piston rod via a pivot fastener pin.

It is a common occurrence that the forces and pressure demands exerted on the doorjamb bracket over time due to the repeated opening and closing of the door will eventually weaken its attachment to the doorjamb causing the doorjamb bracket to become loosened or detached from the doorjamb. The screws or other fasteners holding the doorjamb bracket to the doorjamb are loosened due to the fact that loads exerted thereagainst cause these fasteners to enlarge the screw holes in the doorjamb, oftentimes even splintering or splitting the wooden doorjamb.

A loosened doorjamb bracket can be fixed by replacing the original fasteners with larger fasteners, but this method of repair is usually only temporary because the fasteners eventually wear even larger holes in the doorjamb. Another temporary solution is to move the position and location of the bracket on the doorjamb. The amount of distance that the bracket can be moved, however, is severely limited by both the dimensions of the doorjamb and due to the fact that the bracket must line up with the balance of the door closure system.

Since loosening of the doorjamb bracket is a common problem, it is desirable to provide hardware for reinforcing the attachment of the doorjamb bracket to the doorjamb, preferably before damage is done, but which attachment is effective even after the fastener holes have been enlarged or completely splintered out of the wood. There are several manufacturers of door closure systems and the various doorjamb brackets associated with such various systems all vary in some fashion one from the other. To be commercially practical, taking into consideration the economy of stocking at the retail level, any reinforcement hardware should be adaptable for use with most of the doorjamb brackets on the market today.

Previous attempts at solving the problems set forth above have been made as shown, for example, in U.S. Pat. Nos. 5,829,098 and 4,648,151. These previous devices, however, suffer from one or more of the following disadvantages: (1) the conventional doorjamb bracket is secured on top of the reinforcement bracket rather than between the reinforcement bracket and the doorjamb, leading to less stability and a greater likelihood that the doorjamb bracket will become detached from the reinforcement bracket; (2) the screws or other fasteners associated with these reinforcement devices do not pass through both the reinforcement plate and the doorjamb bracket, leading to less stability in the system as a whole and a greater likelihood that the entire assembly will become detached from the doorjamb; and (3) the known reinforcement devices are not universally adaptable for use with doorjamb brackets of varying configurations.

Accordingly, the present invention is directed to overcoming one or more of the problems set forth above.

SUMMARY OF INVENTION

A conventional door closure system includes a piston, a piston rod, a cylindrical piston tube, and a doorjamb bracket having a base with an arm structure mounted thereto, the arm being adapted for attachment to one end portion of the piston rod. The base typically includes a relatively flat upper surface and a plurality of fastener holes adaptable for receiving suitable fasteners for attaching the doorjamb bracket to a doorjamb. The present invention serves as a reinforcement mechanism for attaching the doorjamb bracket to a doorjamb and its use substantially prevents the doorjamb bracket from being loosened or splintering out of the doorjamb. The present assembly is adapted to fit most doorjamb brackets and can be used with top, bottom or middle mounted door closure systems.

One embodiment of the present hardware includes a relatively flat reinforcement plate having a pocket or chambered portion associated therewith adapted for receipt of the base of the doorjamb bracket. The plate member includes an aperture formed in the pocket portion through which the arm of the doorjamb bracket passes, and further includes elongated openings likewise formed in the pocket portion so as to register with the fastener holes associated with a typical doorjamb bracket for attaching the reinforcement plate and the doorjamb bracket simultaneously to the doorjamb. The plate member also includes a plurality of holes in its unchambered portion flanking the aperture through which the doorjamb bracket arm passes for receiving additional fasteners to attach the reinforcement plate directly to the doorjamb. In use, forces applied to the fastener screws attaching the present plate member and the doorjamb bracket to the doorjamb are distributed over other portions of the plate member and to the additional fastener screws located in the remainder of the plate member thereby reducing the stresses and loads exerted on the doorjamb bracket itself.

Another embodiment of the present invention includes a two-piece bracket assembly instead of the one-piece reinforcement plate described above. The two-piece embodiment does not require the use of a defined aperture for receiving the arm of the doorjamb bracket, but instead, merely flanks and overlays at least a portion of the doorjamb bracket base on opposite sides thereof to achieve attachment. The two-piece bracket assembly provides greater flexibility and adaptability in mating with the wide variety of different doorjamb brackets presently in use.

These and other features and advantages of the present invention will become apparent to those skilled in the art after considering the following detailed specification in conjunction with the accompanying drawings.

BRIEF DESCRIPTION OF THE DRAWINGS for a better understanding of the present invention, reference may be made to the accompanying drawings.

DETAILED DESCRIPTION

Figure 1:
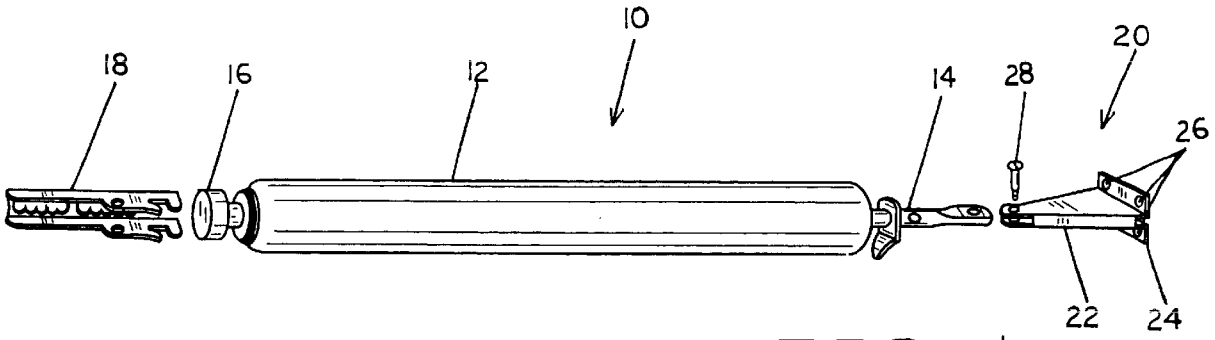
FIG. 1 PRIOR ART
FIG. 1 is an exploded perspective view of a representative prior art door closure system.
Figure 2:
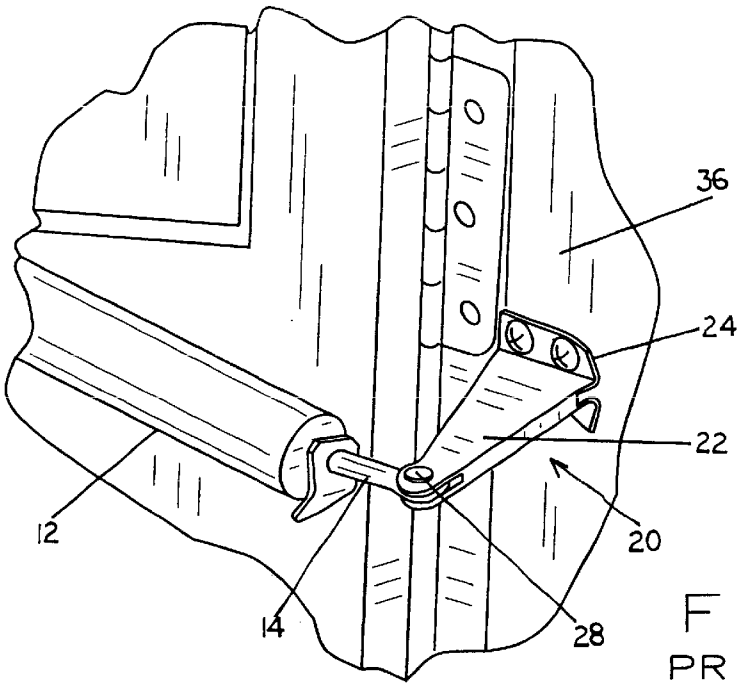
FIG. 2 PRIOR ART
FIG. 2 is a partial perspective view illustrating the attachment of the prior art door closure system of FIG. 1 to a doorjamb.
Figure 3:
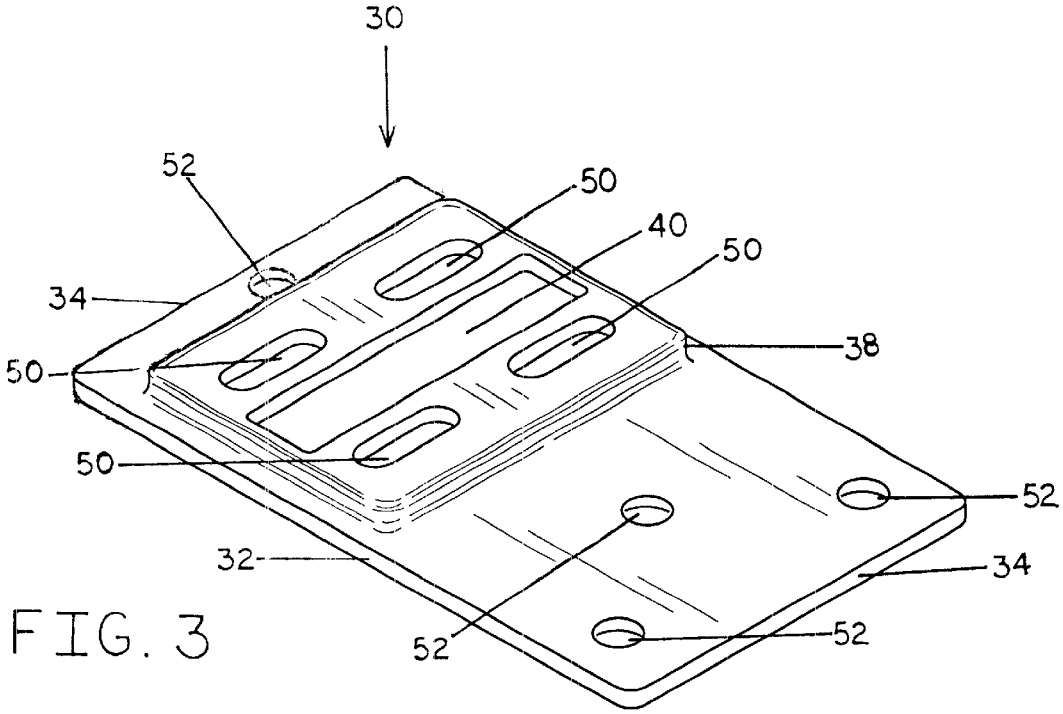
FIG. 3 is a perspective view of a one-piece reinforcement plate for use with a doorjamb bracket constructed in accordance with the teachings of present invention.
Figure 4:
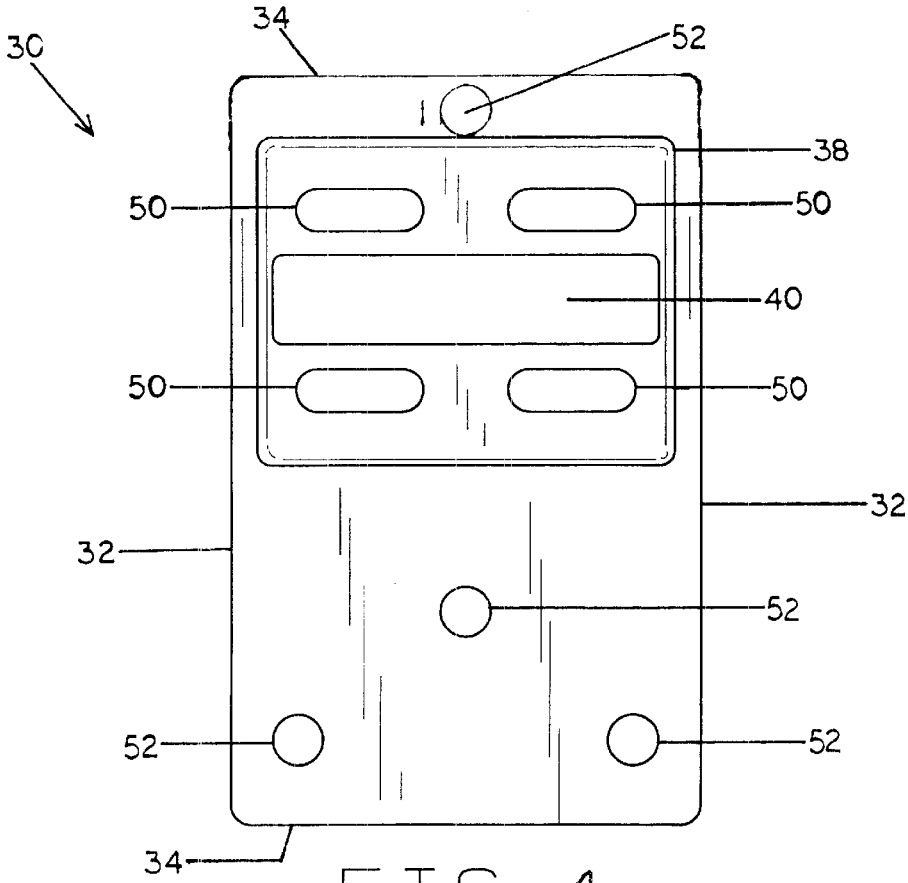
FIG. 4 is a top plan view of the one-piece reinforcement plate illustrated in FIG. 3.
Figure 8:
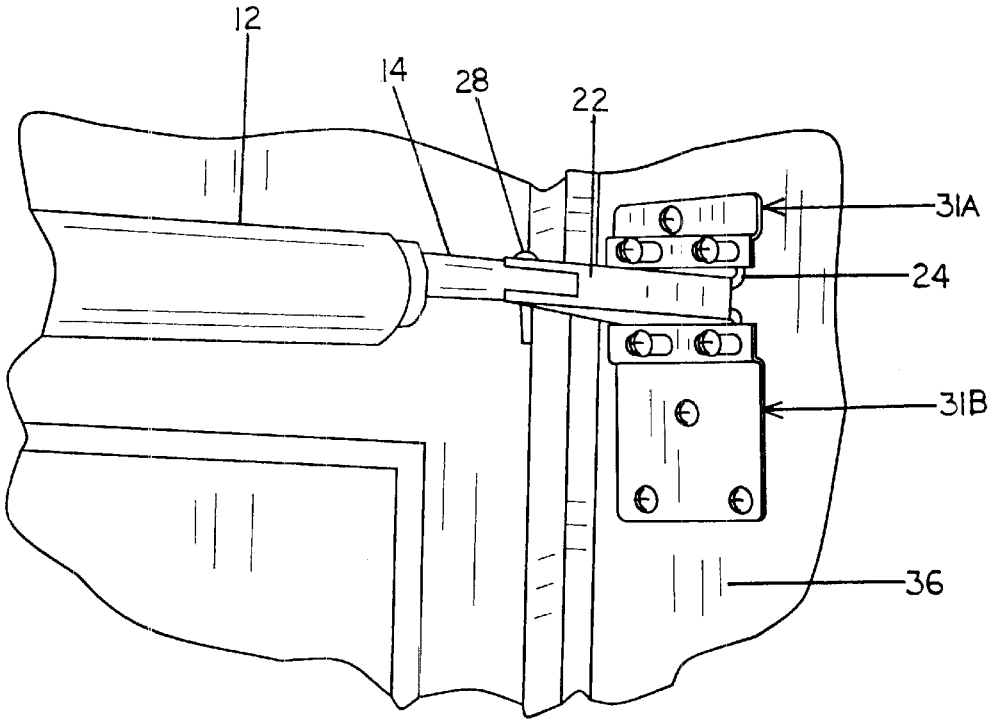
FIG. 8 is a partial perspective view of a prior art door closure system illustrating a typical doorjamb bracket reinforced by the present two-piece reinforcement bracket assembly in accordance with the teachings of the present invention.
Figure 5:
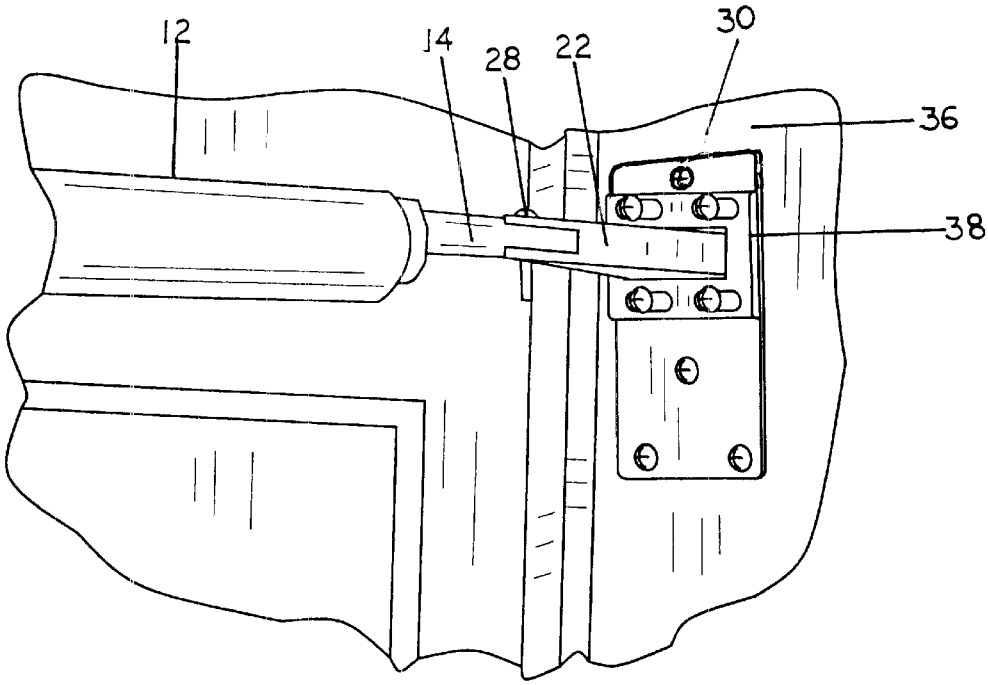
FIG. 5 is a partial perspective view of a prior art door closure system illustrating a typical doorjamb bracket reinforced by the present one-piece reinforcement plate in accordance with the teachings of the present invention.
Figure 7:
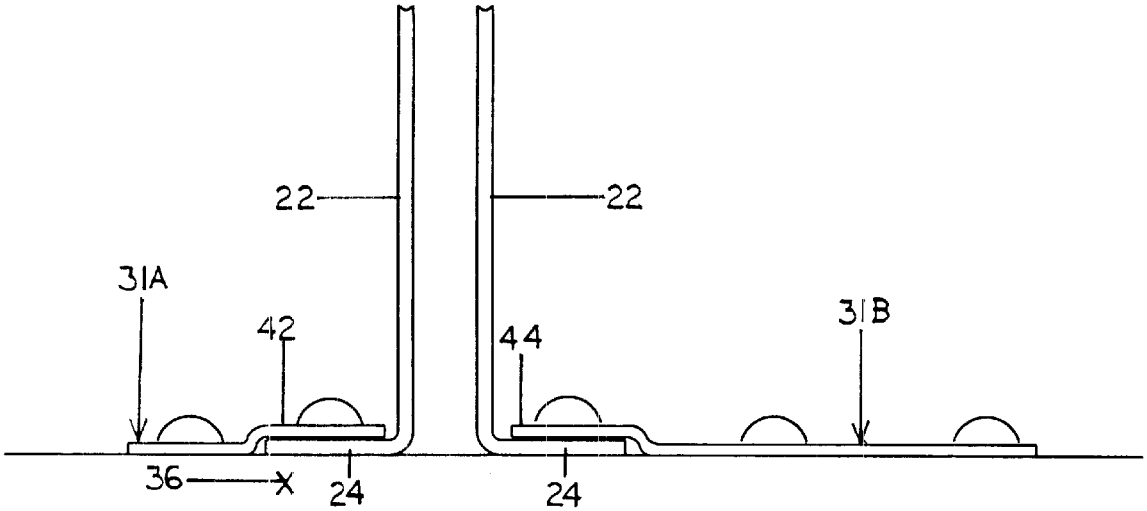
FIG. 7 is a side elevational view of the two-piece reinforcement bracket assembly illustrated in FIG. 6 shown in operative position mounted over portions of a typical doorjamb bracket.
Figure 6:
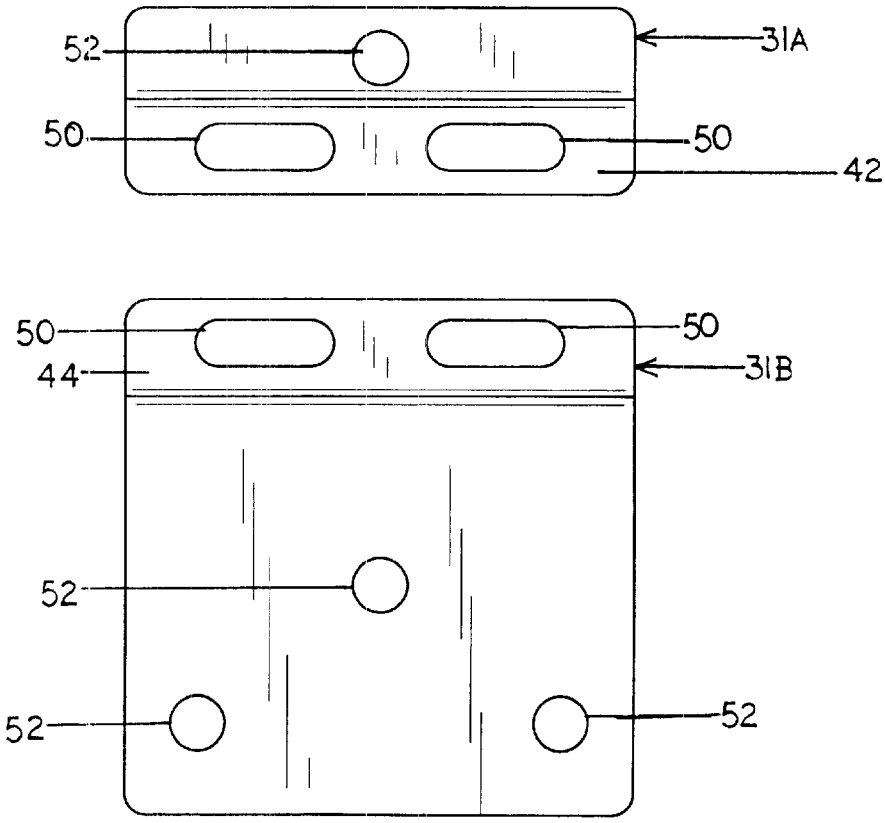
FIG. 6 is a top plan view of a two-piece reinforcement bracket assembly for use with a doorjamb bracket constructed in accordance with the teachings of the present invention.

Referring to the drawings more particularly by reference numbers wherein like numerals refer to like parts, number 10 in FIGS. 1 and 2 identifies a prior art door closure system, number 30 in FIGS. 3–5 identifies a one-piece reinforcement plate for use with a doorjamb bracket constructed and installed in accordance with the teachings of the present invention, and number 31 in FIGS. 6–8 identifies a two-piece bracket assembly for reinforcing a doorjamb bracket constructed and installed in accordance with the teachings of the present invention.

A conventional pneumatic door closure system as shown in FIG. 1 is typically comprised of a piston (not shown) housed within a piston cylinder 12, the piston being connected to a piston rod 14 which extends and projects outwardly from one end portion of the cylinder 12. An end cap 16 is attached to the piston cylinder at the opposite end thereof from piston rod 14. The end cap 16 is removably attached to an adjustable door bracket 18 which in turn is connected to the door (not shown) that is meant to be closed by the door closure system 10. Piston rod 14 is removably attached to a doorjamb bracket such as the bracket 20 shown in FIGS. 1 and 2. Doorjamb bracket 20 is typically fastened to a doorjamb such as doorjamb 36 by means of conventional screws or other fastening devices. It is doorjamb bracket 20 that is susceptible to the forces of the door and door closure system 10 and which, over time, may be pulled from doorjamb 36.

Doorjamb bracket 20 includes an arm 22 and a base 24, and is usually manufactured from a single piece of steel or other suitable material stamped into the above-mentioned functional configuration. Arm 22 includes a terminal end portion adapted to receive and engage the piston rod 14 and base 24 is generally flat, top and bottom, with a plurality of fastener holes 26, typically four fastener holes, for attaching the bracket 20 to the doorjamb 36. One end of piston rod 14 is attached to the terminal or free end of arm 22 via a pivot fastener pin 28. Doorjamb bracket 20 is attached to doorjamb 36 with conventional fastener screws as illustrated in FIG. 2.

FIGS. 3–5 illustrate one embodiment 30 of a doorjamb bracket reinforcement plate constructed in accordance with the teachings of the present invention. Reinforcement plate 30 is adapted for use with a conventional door closure system such as the system 10 illustrated in FIGS. 1 and 2 and is generally rectangular in shape as shown. Reinforcement plate 30 is preferably of a one-piece construction with longer side edges 32 and shorter end edges 34. The plate 30 is adapted to attach to a doorjamb 36 with its longer side edges 32 generally parallel to the vertical axis of doorjamb 36. Doorjambs of relatively new construction tend to be narrower than those of older construction. It is therefore desirable that reinforcement plate 30 be narrower along end edges 34 than the narrowest doorjamb that is likely to be encountered.

Reinforcement plate 30 also includes a chambered or pocket portion 38 as best shown in FIG. 3 within which base 24 of doorjamb bracket 20 is received. Pocket 38 preferably has a substantially flat bottom surface for mating with and contacting the substantially flat upper surface of base 24. Arm 22 of doorjamb bracket 20 passes through an aperture 40 formed in the chambered portion 38 of plate 30 which is shaped and dimensioned for that purpose. The chambered portion 38 allows the base 24 of doorjamb bracket 20 to be positioned and captured in an overlaying relationship between the reinforcement plate 30 and the doorjamb 36 thereby providing a more stable and secure arrangement. As best shown in FIGS. 3 and 4, aperture 40 is preferably located closer to one of the end edges 34 than the other, rather than being located substantially in the middle or center of plate 30. This offset configuration helps to distribute the loads exerted on the fasteners holding the bracket 20 to the doorjamb 36 to other portions of the plate 30 and it also facilitates the positioning and orientation of the plate member based upon the location of the door closure system relative to the door as will be hereinafter further explained.

Four elongated fastener screw holes 50 flank aperture 40, the openings 50 being positioned and located in the chambered portion 38 to register with fastener screw holes 26 found in base 24 of doorjamb bracket 20. Fastener openings 50 are elongated so that reinforcement plate 30 can be used with and positioned over a wide variety of different door closure systems provided by many different manufacturers such as the system 10 illustrated in FIGS. 1 and 2 since the location and spacing between the fastener openings 26 will typically vary from one door closure system to another. The holes or openings 50 therefore provide flexibility and adjustability when attempting to align the holes 50 of plate 30 with the holes 26 of doorjamb bracket 20 when mounting the reinforcement plate 30 to a particular doorjamb bracket. It is also apparent that the four elongated screw holes 50 could be consolidated and replaced with two such elongated openings, one on each side of aperture 40, although some loss in structural integrity of the overall plate 30 may occur. Other hole arrangements and variations are likewise recognized and anticipated.

The reinforcement plate 30 also includes a pattern of additional fastener screw holes 52 distributed in that portion of the plate 30 which does not include the chambered portion 38 as best shown in FIGS. 3 and 4. In the particular embodiment shown in FIGS. 3 and 4, four holes or openings 52 are shown, although it is anticipated and recognized that any plurality of openings 52 may be distributed in the unchambered portion of the plate 30. In this regard, it is appreciated that more or less holes may be appropriate in some cases depending upon the particular application. It is also important to note that reinforcement plate 30 includes at least one opening or hole 52 positioned and located on the shorter unchambered portion of plate member 30 so as to provide further strength and stability to the plate 30 when mounted over an existing doorjamb bracket 20 and attached to the doorjamb 36. The openings 52, unlike the elongated openings 50, allow the plate 30 to be attached directly to the doorjamb 36. The arrangement and distribution of the openings 52 over the unchambered portion of the plate 30 allows the forces and loads exerted on the bracket 20 captured within the chambered portion 38 to be distributed to the unchambered portions of the plate 30 and to the particular fasteners extending through the openings 52 as best illustrated in FIG. 5.

A door closure system such as the system 10 illustrated in FIGS. 1 and 2 can be attached to a particular door in any one of three basic orientations. Depending upon the particular type and structure of door, the closure system 10 could be mounted at the top of the door; it could be mounted towards the middle portion of the door; or it could be mounted at the bottom portion of the door. The present reinforcement plate 30 can be utilized in any one of the three mounting arrangements. For example, when the door closure system is mounted to the top portion of a particular door, the one-piece reinforcement plate 30 is oriented and mounted on the doorjamb 36 such that the longer unchambered portion of the plate 30 extends below the arm 22 of the doorjamb bracket 20 when the arm is positioned through aperture 40. In the embodiments illustrated in FIGS. 3–5, the unchambered portion of the plate 30 housing the three openings 52 is located below arm 22 and the shorter unchambered portion extends above the arm 22 where less doorjamb is available for attachment. It is apparent that the opposite orientation and arrangement of the plate 30 relative to the arm 22 of a particular doorjamb bracket 20 will be utilized if the door closure system 10 is mounted towards the bottom portion of a particular door. Where a particular door closure system 10 is mounted towards the middle of the door, it makes no difference how the reinforcement plate 30 is oriented relative to the doorjamb bracket 20. In this particular situation, it is also recognized and anticipated that the chambered portion 38 and the aperture 40 located therewithin can be positioned and located more towards the center or middle of the overall plate 30. Although this orientation of aperture 40 will work well for a middle-mounted door closure system 10, the offset configuration of aperture 40 illustrated in FIGS. 3–5 provides greater flexibility and adaptability for utilizing the plate 30 in both a top-mounted and bottom-mounted door closure system application.

FIG. 5 illustrates attachment of the present plate 30 to a top-mounted door closure system 10. When reinforcement plate 30 is installed, aperture 40 is slipped over arm 22 of doorjamb bracket 20 such that the doorjamb bracket base 24 is received within chambered portion 38. If reinforcement plate 30 is installed over an existing doorjamb bracket 20, the fastener screws holding doorjamb bracket 20 to doorjamb 36 are removed prior to inserting arm 22 through aperture 40. Fastener screws for doorjamb bracket 20 are then passed through elongated holes 50 in reinforcement plate 30 and through holes 26 in bracket base 24 and threaded into doorjamb 36. These fasteners attach both the plate 30 and the doorjamb bracket 20 to the doorjamb 36. Depending upon the condition of the holes in the doorjamb 36 previously holding the doorjamb bracket 20 in place, it may be necessary to use slightly larger screws for attaching plate 30 and base 24 to doorjamb 36. If these pre-existing holes in doorjamb 36 are too greatly enlarged such that larger screws will not adequately secure base 24 to doorjamb 36, it may then be necessary to reposition doorjamb bracket 20 on doorjamb 36 as would normally occur to one making a repair without reinforcement plate 30. Additional threaded fastener screws are then passed through outlying holes 52 in reinforcement plate 30 and threaded into doorjamb 36. When the piston rod 14 is attached to arm 22 and the door is opened and closed, the load on the fastener screws extending through elongated openings 50 is distributed over pocket portion 38 and to the additional fastener screws extending through openings 52 such that the fasteners extending through the openings 50 and attaching doorjamb bracket 20 to the doorjamb do not loosen or tear out of doorjamb 36 during use.

FIGS. 6–8 illustrate another embodiment of the present invention wherein the one-piece plate 30 is replaced with a two-piece bracket assembly 31 having first and second members 31A and 31B associated therewith. The two-piece bracket assembly 31 is substantially similar to the one-piece plate 30 in that it likewise includes elongated openings 50 and additional fastener openings 52. The bracket assembly 31 differs from plate 30 in that it does not include an enclosed chambered portion 38, nor does it include a specifically defined aperture 40. Instead, as best shown in FIG. 7, one end portion of each of the bracket portions 31A and 31B includes a raised flange portion 42 and 44 respectively, each raised flange portion forming a recessed area therebeneath sufficient to overlay and accommodate at least a portion of the base 24 associated with doorjamb bracket 20. In use, the shorter bracket portion 31A will be positioned adjacent one side of doorjamb bracket 20 such that flange portion 42 overlays one side of base 24 and the elongated openings 50 associated therewith lie in registration with the holes or openings 26 associated with that portion of base 24. In similar fashion, the larger bracket portion 31B is positioned and oriented adjacent the opposite side of doorjamb bracket 20 such that flange portion 44 overlays an opposite side portion of base 24 such that the elongated openings 50 lie in registration with the openings or holes 26 associated with that portion of base 24. Suitable fastener members are then positioned through the openings 50 associated with bracket members 31A and 31B and through the respective holes or openings 26 associated with the doorjamb bracket 20 thereby initially and simultaneously securing such bracket portions and the doorjamb bracket 20 to the doorjamb 36. The remaining portions of the brackets 31A and 31B are then further attached to the doorjamb 36 by threadedly engaging additional fastener members through the fastener openings 52 in the same manner as previously described with respect to plate 30 thereby further securing and directly attaching the respective bracket members 31A and 31B to the corresponding doorjamb 36. Base 24 of doorjamb bracket 20 is now flanked and snugly retained between the two-piece bracket assembly 31 and doorjamb 36.

The arrangement of an installed two-piece bracket assembly 31 is more clearly illustrated in FIG. 8. Even if the base 24 of doorjamb bracket 20 is dimensionally greater than the overall length of the bracket members 31A and 31B, the two-piece bracket assembly 31 will still securely hold the doorjamb bracket 20 in proper position and will achieve the same results and objectives as previously explained with respect to plate 30.

As with plate 30, the two-piece bracket assembly 31 can be positioned and oriented relative to the doorjamb bracket 20 and the doorjamb 36 so as to accommodate a top-mounted, a middle-mounted, or a bottom-mounted door closure system. In all other respects, the mounting and operation of bracket assembly 31 is substantially similar to the mounting and operation of reinforcement plate 30. Also, importantly, since no defined aperture such as the aperture 40 in plate 30 is associated with bracket assembly 31, this assembly is more universal and is adaptable for use with a wide variety of different door closure systems including oversized doorjamb brackets which may not be sized and dimensioned to fit within the chambered portion 38 or extend through aperture 40 associated with plate 30. Instead, the two-piece bracket assembly 31 can be used in those situations where reinforcement plate 30 is not sized to accommodate the particular doorjamb bracket being utilized.

As is evident from the foregoing description, certain aspects of the present invention are not limited by the particular details of the examples illustrated herein and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A reinforcement plate for use in attaching a doorjamb bracket to a doorjamb, the doorjamb bracket having an arm, a base, and a plurality of holes associated with the base for receiving fasteners therethrough, the reinforcement plate comprising:

a plate member;

an aperture extending through said plate member, said aperture being sized and shaped to receive the arm of the doorjamb bracket when positioned therethrough;

a plurality of openings in said plate member through which fasteners may be inserted to attach said plate member to the doorjamb; and at least one additional opening in said plate member positioned and located so as to register with at least one of the plurality of holes associated with the base of the doorjamb bracket when the arm of the doorjamb bracket is received through said aperture such that a fastener may be inserted respectively therethrough to simultaneously affix said plate member and the doorjamb bracket to the doorjamb;

the doorjamb bracket being held securely between said plate member and the doorjamb when fasteners are positioned through said plurality of openings and through said at least one additional opening and affixed to the doorjamb.

2. The reinforcement plate of claim 1 wherein said plate member further includes a chambered portion which is sized, shaped and disposed such that the base of the doorjamb bracket is received therewithin when the arm of the doorjamb bracket is received through said aperture.

3. The reinforcement plate of claim 2 wherein said aperture and said at least one additional opening are positioned and located on that chambered portion of said plate member.

4. The reinforcement plate of claim 1 wherein said plate member includes a plurality of additional openings positioned and located in said plate member so as to register with the plurality of the holes associated with the base of the doorjamb bracket when the arm of the doorjamb bracket is received through said aperture.

5. A reinforcement plate for use in attaching a doorjamb bracket to a doorjamb, the doorjamb bracket having a base, an arm, and a plurality of holes associated with the base for receiving fasteners therethrough, the reinforcement plate comprising:

a plate member having a substantially flat bottom surface;

an aperture extending through said plate member, said aperture being sized and shaped to receive the arm of the doorjamb bracket when positioned therethrough;

a chambered portion formed within said plate member for receiving the base of the doorjamb bracket when the arm of the doorjamb bracket is inserted through said aperture;

a plurality of openings extending through said plate member for receiving fasteners for attaching said plate member to a doorjamb, at least some of said plurality of openings being positioned and located so as to register with at least some of the plurality of holes associated with the base of the doorjamb bracket when the arm of the doorjamb bracket is inserted through said aperture;

the doorjamb bracket being securely held between said plate member and the doorjamb when fasteners are positioned through said plurality of openings and affixed to the doorjamb.

6. The reinforcement plate of claim 5 wherein said plate member includes opposed end portions, said aperture being disposed closer to one of said opposed end portions.

7. The reinforcement plate of claim 6 wherein at least one of said plurality of openings is located between said aperture and the end portion of said plate member disposed closest thereto.

8. The reinforcement plate of claim 5 wherein at least one of said plurality of openings positioned and located so as to register with some of the plurality of holes associated with the base of the doorjamb bracket is positioned and located on each opposite side of said aperture.

9. A reinforcement plate for use in attaching a doorjamb bracket to a doorjamb, the doorjamb bracket having an arm, a base, and a plurality of holes associated with the base for receiving fasteners therethrough, the reinforcement plate comprising:

a substantially rectangular plate member having opposed end portions, said plate member having a portion thereof forming a chambered area for receiving the base of the doorjamb bracket;

an aperture formed through that portion of the plate member forming the chambered area, said aperture being sized and shaped to receive the arm of the doorjamb bracket and being disposed closer to one end portion of said plate member;

a plurality of openings extending through the unchambered portion of said plate member for receiving fasteners therethrough for attaching said plate member to the doorjamb, at least one of said openings being located between said aperture and the opposed end portion of said plate member closest to said aperture; and a plurality of elongated openings extending through the chambered portion of said plate member, said elongated openings being positioned and located so as to register with the plurality of holes associated with the base of the doorjamb bracket when the arm of the doorjamb bracket is inserted through said aperture;

the doorjamb bracket being held securely between said plate member and the doorjamb when fasteners are positioned through said plurality of openings in both the chambered and unchambered portions of said plate member and engaged with the doorjamb.

10. A bracket assembly for use in attaching a doorjamb bracket to a doorjamb, the doorjamb bracket having a base and a plurality of holes associated with the base for receiving fasteners therethrough, said bracket assembly comprising:

a first member having a raised portion associated therewith adapted for overlaying at least a portion of the base of the doorjamb bracket, said first member having at least one opening associated therewith through which a fastener may be inserted for attaching said first member to the doorjamb;

a second member having a raised portion associated therewith adapted for overlapping at least a portion of the base of the doorjamb bracket, said second member having at least one opening associated therewith through which a fastener may be inserted for attaching said second member to the doorjamb;

said first and second members being positioned and located relative to the doorjamb bracket so as to flank the doorjamb bracket with the raised portion of each of said first and second members overlaying at least a portion of the base of the doorjamb bracket;

the doorjamb bracket being held securely between said first and second members and the doorjamb when fasteners are positioned through said at least one opening associated with each of said first and second members and affixed to the doorjamb.

11. The bracket assembly of claim 10 wherein said at least one opening associated with each of said first and second members is positioned and located on the unraised portion of each of said members.

12. The bracket assembly of claim 10 wherein said at least one opening associated with each of said first and second members is positioned and located on the raised portion of each of said members, said at least one opening being positioned and located so as to register with at least one of the holes associated with the base of the doorjamb bracket when each of said raised portions are positioned in overlaying relationship with at least a portion of the base of the doorjamb bracket.

13. The bracket assembly of claim 10 wherein said first and second members each include at least one opening positioned and located on the raised portion of said members so as to register with at least one of the holes associated with the base of the doorjamb bracket when each of said raised portions are positioned in overlaying relationship with at least a portion of the base of the doorjamb bracket.

14. The bracket assembly of claim 10 wherein said first member is sized and shaped so as to be smaller than said second member.

15. A bracket assembly for reinforcing the attachment of a doorjamb bracket to a doorjamb, the doorjamb bracket having an arm, a base, and a plurality of holes associated with the base for receiving fasteners theretbrough, the bracket assembly comprising:

a first portion;

a second portion sized and shaped to be used in combination with said first portion for flanking the doorjamb bracket;

said first and second portions each further having a raised portion sized, shaped and disposed such that at least a portion of the base of the doorjamb bracket is received thereunder when said first and second portions are secured in operable relationship to the doorjamb bracket such that the doorjamb bracket remains in direct contact with the doorjamb; and a plurality of openings in said first and second portions through which fasteners may attach said portions to the doorjamb such that the doorjamb bracket is held securely between said first and second portions and the doorjamb, wherein each of said first and second portions further includes at least one opening of said plurality of openings positioned and located such that a fastener may be inserted through said at least one opening and through a hole associated with the base of the doorjamb bracket so as to simultaneously attach each of said first and second portions respectively to both the doorjamb bracket and the doorjamb.

16. A bracket assembly for use in attaching a doorjamb bracket to a doorjamb, the doorjamb bracket having an arm, a base, and a plurality of holes associated with the base for receiving fasteners therethrough, said bracket assembly comprising:

a first member having a raised portion associated therewith adapted for overlaying at least a portion of the base of the doorjamb bracket when said first member is operatively positioned adjacent thereto, said first member including a plurality of openings for receiving fastener members therethrough, at least one of said plurality of openings being positioned and located on the raised portion of said first member so as to register with at least one of the plurality of holes associated with the base of the doorjamb bracket when said first member is operatively positioned adjacent the doorjamb bracket, and at least one of said plurality of openings being positioned and located in the unraised portion of said first member;

a second member having a raised portion associated therewith adapted for overlaying at least a portion of the base of the doorjamb bracket when said second member is operatively positioned adjacent thereto, said second member including a plurality of openings for receiving fasteners therethrough, at least one of said plurality of openings being positioned and located on the raised portion of said second member so as to register with at least one of the plurality of holes associated with the base of the doorjamb bracket when said second member is operatively positioned adjacent the doorjamb bracket, and at least one of said plurality of openings being located in the unraised portion of said second member;

said first and second members being operatively positioned adjacent the doorjamb bracket such that the raised portion associated with each of said first and second members overlays at least a portion of the doorjamb bracket on opposite sides thereof such that when fasteners are positioned through the respective plurality of openings associated with each of said first and second members and attached to the doorjamb, the unraised portion of each of said first and second members will be attached directly to the doorjamb and the raised portion of each of said first and second members will simultaneously attach the base of the doorjamb bracket to the doorjamb.

17. The bracket assembly of claim 16 wherein said at least one of said plurality of openings associated with the raised portion of each of said first and second members includes an elongated slot.

18. The bracket assembly of claim 16 wherein said second member is sized and shaped so as to be larger than said first member, the plurality of openings associated with said second member being distributed such that at least two of said openings are associated with the raised portion of said second member.

19. A bracket assembly for reinforcing the attachment of a doorjamb bracket to a doorjamb, the doorjamb bracket having an arm, a base, and a plurality of holes associated with the base for receiving fasteners therethrough, the bracket assembly comprising:

a first portion;

a second portion sized and shaped to be used in combination with said first portion for flanking the doorjamb bracket;

said first and second portions each further having a raised area sized, shaped and disposed such that at least a portion of the base of the doorjamb bracket is received thereunder when said first and second portions are secured in operable relationship to the doorjamb bracket;

a plurality of openings distributed between said first and second portions through which fasteners may attach said first and second portions to the doorjamb such that the doorjamb bracket is held securely between said first and second portions and the doorjamb; and at least one of said plurality of openings in each of said first and second portions being located such that a fastener may be inserted simultaneously through one of said fist and second portions and through one of the plurality of holes in the base of the doorjamb bracket so as to simultaneously attach one of said first and second portions and the doorjamb bracket to the doorjamb.

20. A bracket assembly for use in attaching a doorjamb bracket to a doorjamb, the doorjamb bracket having a base and a plurality of holes associated with the base for receiving fasteners therethrough, said bracket assembly comprising:

a first member having a raised portion associated therewith adapted for overlaying at least a portion of the base of the doorjamb bracket, said first member having at least one opening associated therewith through which a fastener may be inserted for attaching said first member to the doorjamb;

a second member having a raised portion associated therewith adapted for overlapping at least a portion of the base of the doorjamb bracket, said second member having at least one opening associated therewith through which a fastener may be inserted for attaching said second member to the doorjamb;

said first and second members being positioned and located relative to the doorjamb bracket so as to flank the doorjamb bracket with the raised portion of each of said first and second members overlaying at least a portion of the base of the doorjamb bracket;

the doorjamb bracket being held securely between said first and second members and the doorjamb when fasteners are positioned through said at least one opening associated with each of said first and second members and affixed to the doorjamb;

and wherein said at least one opening associated with each of said first and second members is positioned and located on the raised portion of each of said members, said at least one opening being positioned and located so as to register with at least one of the holes associated with the base of the doorjamb bracket when each of said raised portions are positioned in overlaying relationship with at least a portion of the base of the doorjamb bracket.

21. A bracket assembly for use in attaching a doorjamb bracket to a doorjamb, the doorjamb bracket having a base and a plurality of holes associated with the base for receiving fasteners therethrough, said bracket assembly comprising:

a first member having a raised portion associated therewith adapted for overlaying at least a portion of the base of the doorjamb bracket, said first member having at least one opening associated therewith through which a fastener may be inserted for attaching said first member to the doorjamb;

a second member having a raised portion associated therewith adapted for overlapping at least a portion of the base of the doorjamb bracket, said second member having at least one opening associated therewith through which a fastener may be inserted for attaching said second member to the doorjamb;

said first and second members being positioned and located relative to the doorjamb bracket so as to flank the doorjamb bracket with the raised portion of each of said first and second members overlaying at least a portion of the base of the doorjamb bracket;

the doorjamb bracket being held securely between said first and second members and the doorjamb when fasteners are positioned through said at least one opening associated with each of said first and second members and affixed to the doorjamb;

and wherein said first and second members each include at least one opening positioned and located on the raised portion of said members so as to register with at least one of the holes associated with the base of the doorjamb bracket when each of said raised portions are positioned in overlaying relationship with at least a portion of the base of the doorjamb bracket.

22. A bracket assembly for reinforcing the attachment of a doorjamb bracket to a doorjamb, the doorjamb bracket having an arm, a base, and plurality of holes associated with the base for receiving fasteners therethrough, the bracket assembly comprising:

a first portion;

a second portion sized and shaped to be used in combination with said first portion for flanking the doorjamb bracket;

said first and second portions each further having a raised portion sized, shaped and disposed such that at least a portion of the base of the doorjamb bracket is received thereunder when said first and second portions are secured in operable relationship to the doorjamb bracket;

a plurality of openings in said first and second portions through which fasteners may attach said portions to the doorjamb such that the doorjamb bracket is held securely between said first and second portions and the doorjamb;

and wherein each of said first and second portions further includes at least one opening positioned and located such that a fastener may be inserted through said at least one opening and through a hole associated with the base of the doorjamb bracket so as to simultaneously attach each of said first and second portions respectively to both the doorjamb bracket and the doorjamb.

* * * * *